US009286745B2

(12) United States Patent
Okada

(10) Patent No.: US 9,286,745 B2
(45) Date of Patent: Mar. 15, 2016

(54) GAMING SYSTEM, SERVER, GAMING TERMINAL, INCLUDING A CURRENCY EXCHANGE MODULE AND GAME CONTROL METHOD

(75) Inventor: Kazuo Okada, Tokyo (JP)

(73) Assignee: ARUZE GAMING AMERICA, INC., Las Vegas, NV (US)

( * ) Notice: Subject to any disclaimer, the term of this patent is extended or adjusted under 35 U.S.C. 154(b) by 1529 days.

(21) Appl. No.: 11/723,266

(22) Filed: Mar. 19, 2007

(65) Prior Publication Data

US 2008/0076533 A1 Mar. 27, 2008

Related U.S. Application Data

(60) Provisional application No. 60/846,339, filed on Sep. 22, 2006.

(51) Int. Cl.
*G07F 17/32* (2006.01)

(52) U.S. Cl.
CPC ..... *G07F 17/32* (2013.01); *G07F 17/3244* (2013.01); *G07F 17/323* (2013.01); *G07F 17/3248* (2013.01)

(58) Field of Classification Search
CPC G07F 17/323; G07F 17/3244; G07F 17/3248
USPC ..... 463/25, 42
See application file for complete search history.

(56) References Cited

U.S. PATENT DOCUMENTS 6,110,042 A * 8/2000 Walker et al. ..... 463/25
6,545,077 B2 4/2003 Hill et al.
6,645,077 B2 * 11/2003 Rowe ..... 463/42
6,663,487 B1 * 12/2003 Ladner ..... 463/13
6,884,173 B2 * 4/2005 Gauselmann ..... 463/42
6,935,946 B2 * 8/2005 Yoseloff et al. ..... 463/16
7,267,614 B1 * 9/2007 Jorasch et al. ..... 463/25
7,390,264 B2 * 6/2008 Walker et al. ..... 463/42
7,503,851 B2 * 3/2009 Walker et al. ..... 463/26
7,549,920 B2 * 6/2009 Jorasch et al. ..... 463/16
7,722,453 B2 * 5/2010 Lark ..... G06Q 20/382 296/181.6
7,850,524 B2 * 12/2010 Jackson ..... 463/27
7,862,421 B2 * 1/2011 Marks et al. ..... 463/20
7,878,896 B2 * 2/2011 Jorasch et al. ..... 463/20
7,985,135 B2 * 7/2011 Fujimoto et al. ..... 463/26
8,075,394 B2 * 12/2011 Okada et al. ..... 463/25
8,512,132 B2 * 8/2013 Nicely ..... 463/27
8,690,681 B2 * 4/2014 Swarna ..... 463/42
8,721,447 B2 * 5/2014 Okada ..... G07F 17/3225 463/16
8,821,256 B2 * 9/2014 Okada et al. ..... 463/25
8,986,113 B2 * 3/2015 Logan et al. ..... 463/29
2001/0019965 A1 * 9/2001 Ochi ..... 463/25
2001/0041610 A1 * 11/2001 Luciano et al. ..... 463/16
2001/0053712 A1 * 12/2001 Yoseloff et al. ..... 463/1

(Continued)

*Primary Examiner* — William H McCulloch, Jr.
(74) *Attorney, Agent, or Firm* — Lex IP Meister, PLLC

(57) ABSTRACT

A game control method according to the present invention comprises: a downloading step conducted by a server of downloading exchange-ratio changing data for use in determining the currency value of a credit in a gaming terminal to the gaming terminal; an exchange ratio determining step conducted by the gaming terminal of determining the exchange ratio between credits and currency values using the exchange-ratio changing data downloaded from the server, and an exchanging step conducted by the gaming terminal of exchanging a monetary value for a credit and/or exchanging a credit for a monetary value, based on the determined exchange ratio.

23 Claims, 10 Drawing Sheets

(56) References Cited

U.S. PATENT DOCUMENTS

| | | | | |
|---|---|---|---|---|
| 2002/0034977 | A1* | 3/2002 | Burns et al. | 463/25 |
| 2002/0042297 | A1* | 4/2002 | Torango | 463/27 |
| 2002/0147040 | A1* | 10/2002 | Walker et al. | 463/25 |
| 2002/0151348 | A1* | 10/2002 | Burns et al. | 463/20 |
| 2002/0151355 | A1* | 10/2002 | Burns et al. | 463/25 |
| 2002/0151356 | A1* | 10/2002 | Burns et al. | 463/25 |
| 2002/0193162 | A1* | 12/2002 | Walker et al. | 463/42 |
| 2003/0003985 | A1* | 1/2003 | Han | 463/17 |
| 2003/0003988 | A1* | 1/2003 | Walker et al. | 463/21 |
| 2003/0022719 | A1* | 1/2003 | Donald et al. | 463/42 |
| 2003/0060279 | A1* | 3/2003 | Torango | 463/27 |
| 2003/0064792 | A1* | 4/2003 | Baerlocher et al. | 463/25 |
| 2003/0083127 | A1* | 5/2003 | Weiss | 463/25 |
| 2003/0216182 | A1* | 11/2003 | Gauselmann | 463/40 |
| 2003/0224858 | A1* | 12/2003 | Yoseloff et al. | 463/43 |
| 2003/0228902 | A1* | 12/2003 | Walker et al. | 463/25 |
| 2004/0152511 | A1* | 8/2004 | Nicely et al. | 463/27 |
| 2004/0204232 | A1* | 10/2004 | Asher et al. | 463/25 |
| 2005/0009598 | A1* | 1/2005 | Rasmussen | G07F 17/32 463/25 |
| 2005/0054448 | A1 | 3/2005 | Frerking et al. | |
| 2005/0209004 | A1* | 9/2005 | Torango | 463/42 |
| 2006/0035713 | A1 | 2/2006 | Cockerille et al. | |
| 2006/0046841 | A1* | 3/2006 | Walker et al. | 463/25 |
| 2006/0068888 | A1* | 3/2006 | Okada et al. | 463/20 |
| 2006/0094498 | A1* | 5/2006 | Jorasch et al. | 463/25 |
| 2006/0121969 | A1* | 6/2006 | Marks et al. | 463/16 |
| 2006/0121984 | A1* | 6/2006 | Jorasch et al. | 463/29 |
| 2006/0128462 | A1* | 6/2006 | Jorasch et al. | 463/25 |
| 2006/0149561 | A1* | 7/2006 | Govender | 705/1 |
| 2006/0205482 | A1* | 9/2006 | Crivelli | 463/25 |
| 2006/0205486 | A1* | 9/2006 | Walker et al. | 463/25 |
| 2006/0217186 | A1* | 9/2006 | Jorasch et al. | 463/25 |
| 2006/0229130 | A1* | 10/2006 | Bender et al. | 463/43 |
| 2006/0252524 | A1* | 11/2006 | Friesen et al. | 463/29 |
| 2007/0060394 | A1* | 3/2007 | Gowin et al. | 463/47 |
| 2007/0173317 | A1* | 7/2007 | Walker et al. | 463/25 |
| 2007/0293309 | A1* | 12/2007 | Jorasch et al. | 463/25 |
| 2008/0058065 | A1* | 3/2008 | Okada | 463/20 |
| 2008/0076533 | A1* | 3/2008 | Okada | 463/25 |
| 2011/0124405 | A1* | 5/2011 | Okada et al. | 463/25 |
| 2012/0135799 | A1* | 5/2012 | Okada et al. | 463/25 |
| 2013/0084966 | A1* | 4/2013 | Nicely | 463/27 |
| 2014/0141872 | A1* | 5/2014 | Rowe | 463/25 |

* cited by examiner

GAMING SYSTEM, SERVER, GAMING TERMINAL, INCLUDING A CURRENCY EXCHANGE MODULE AND GAME CONTROL METHOD

CROSS-REFERENCE TO RELATED APPLICATIONS

This application claims priority of US Provisional Application No. 60/846,339 filed on Sep. 22, 2006. The contents of this application are incorporated herein by reference in their entirety.

BACKGROUND OF THE INVENTION

1. Field of the Invention

The present invention relates to a gaming system, a server, a gaming terminal and a game control method.

2. Discussion of the Background

The specification of U.S. Pat. No. 6,645,077, and the specifications of US 2005/0054448-A1 and US 2006/0035713-A1 disclose gaming systems capable of executing a plurality of types of games in a single gaming terminal or changing the contents of games which can be played in gaming terminals in a network, utilizing techniques for downloading-game programs through a network.

In the aforementioned gaming systems, game software components are downloaded to the respective gaming terminals from a server, and the respective gaming terminals execute games using the downloaded game software components.

It is an object of the present invention to vary game environments without changing the contents of games, for enabling stabilization of the benefit while offering novel entertainment.

The contents of U.S. Pat. No. 6,645,077, US 2005/0054448-A1, and US 2006/0035713-A1 are incorporated herein by reference in their entirety.

SUMMARY OF THE INVENTION

According to the present invention, there is provided a gaming system as follows.

(1) A gaming system according to the present invention includes a server, a plurality of gaming terminals and a network.

The aforementioned server includes (A) a first network interface, (B) a first memory and (C) a processor. The aforementioned first network interface is for communicating with the plurality of gaming terminals. The aforementioned first memory stores exchange-ratio changing data for use in determining the currency value of a credit in the aforementioned gaming terminals. The aforementioned processor is designed or configured to download the aforementioned exchange-ratio changing data to the aforementioned gaming terminals.

The aforementioned gaming terminals include (I) a second network interface, (II) a controller and (III) a second memory. The aforementioned second network interface is for communicating with the aforementioned server. The aforementioned controller (i) determines the exchange ratio between credits and currency values using the aforementioned exchange-ratio changing data downloaded from the aforementioned server. Further, the aforementioned controller (ii) exchanges a monetary value for a credit and/or exchanges a credit for a monetary value based on the determined exchange ratio. The aforementioned second memory stores the exchange-ratio changing data downloaded from the aforementioned server.

The aforementioned network enables communication between the aforementioned server and the aforementioned plurality of gaming terminals.

There is no particular limitation on the hardware structure of the aforementioned server, provided that it can function as the server according to the present invention, and a conventional server can be employed. Further, the aforementioned server can include a firewall and a modem. The aforementioned server can be constituted by either a single device or a plurality of devices. Any one of the aforementioned gaming terminals which includes a firewall and a modem can be configured to function as the aforementioned server.

There is no particular limitation on the aforementioned gaming terminals, and it is possible to employ, for example, gaming machines such as slot machines, personal computers, personal digital assistants, and the like. Further, there is no particular limitation on games which are played in the aforementioned gaming terminals, and such games may be, for example, video bingo games, video lottery games, video blackjack games, video slot games, mechanical slot games, video poker games, video Kino games, video pachinko games, video card games, Video-game-of-chances, and the like.

There is no particular limitation on the aforementioned first network interface, and the aforementioned first network interface can be either a wireless network interface or a wired network interface, provided that it can communicate with a plurality of gaming terminals. This applies to the aforementioned second network interface, and there is no particular limitation on the aforementioned second network interface, provided that it can communicate with the aforementioned server. Further, the communication between the aforementioned server and the aforementioned plurality of gaming terminals can be realized through the internet or an intranet. There is no particular limitation on the aforementioned intranet, and the aforementioned intranet can be, for example, a cashless system network, a progressive game network, an accounting network, a bonus game network and the like. There is no particular limitation on the aforementioned first memory, and the aforementioned first memory can be, for example, a nonvolatile memory, a hard disk drive, a CD-RW drive, a DVD-RAM drive and the like. This applies to the aforementioned second memory.

The exchange-ratio changing data is data for use in determining the currency values of credits and includes data indicating the exchange ratio between credits and currency values (for example, 1 credit=1 dollar). Further, as exchange-ratio changing data, there may be individually defined exchange-ratio changing data for use in exchanging a currency value for a credit (for example, 1 credit/1 dollar) and exchange-ratio changing data for use in exchanging a credit for a currency value (for example, 0.98 dollar/1 credit).

Also, there is no particular limitation on the number of exchange ratios in the exchange-ratio changing data, the number of exchange-ratio changing data, and the like.

There is no particular limitation on triggers which cause the aforementioned processor to download the aforementioned exchange-ratio changing data to the aforementioned gaming terminals, and such triggers may be, for example, a predetermined time, day, week, events and the like. Further, inputs by the player, results of games and game histories may be used as triggers.

Further, according to the present invention, there is provided a configuration as follows.

(2) The gaming system according to the aforementioned (1), wherein the aforementioned first memory stores denomination changing data for use in determining a denomination in the aforementioned gaming terminals, the aforementioned processor is designed or configured to download the aforementioned denomination changing data to the aforementioned gaming terminals, the aforementioned controller is designed or configured to determine the denomination using the aforementioned denomination changing data downloaded from the aforementioned server and execute games based on the determined denomination, and the aforementioned second memory stores the aforementioned denomination changing data downloaded from the aforementioned server.

In the present invention, the denomination refers to a minimum unit of BETs for a single game.

However, in the present invention, the denomination may be either a denomination for currency values or a denomination for credits. The denomination for currency values may be, for example, 0.01 dollar, 0.10 dollar, 0.25 dollar, 1 dollar, 10 dollars, 100 dollars and the like. Further, the denomination for credits may be, for example, 1 credit, 10 credits, 100 credits and the like.

There is no particular limitation on triggers which cause the aforementioned processor to download the aforementioned denomination changing data to the aforementioned gaming terminals, and such triggers may be, for example, a predetermined time, day, week, events and the like. Further, inputs by the player, results of games and game histories may be used as triggers.

Also, in the present invention, along with or instead of the aforementioned denomination changing data, it is possible to employ minimum-BET changing data. The minimum BET refers to a smallest wager required to be betted for a single game. In the present invention, the minimum BET may be either a minimum BET for currency values or a minimum BET for credits. In a case of employing both minimum BET changing data and denomination changing data, the minimum BET may be a different value from that of the denomination.

Further, according to the present invention, there is provided a configuration as follows.

(3) The gaming system according to the aforementioned (1) or (2), wherein the aforementioned first memory stores game software components to be used in the aforementioned gaming terminals, the aforementioned processor is designed or configured to download the aforementioned game software components, the aforementioned controller is designed or configured to produce games to be executed in the aforementioned gaming terminals, using the aforementioned game software components downloaded from the aforementioned server, and the aforementioned second memory stores the aforementioned game software components downloaded from the aforementioned server.

Further, according to the present invention, there is provided a configuration as follows.

(4) The gaming system according to any one of aforementioned (1) to (3), wherein the aforementioned processor is designed or configured to download the aforementioned exchange-ratio changing data to the aforementioned plurality of gaming terminals at the same time, and the aforementioned controller determines the exchange ratio between credits and currency values using the aforementioned exchange-ratio changing data, when the aforementioned exchange-ratio changing data is downloaded from the aforementioned server or after the end of games if games are executed at the time when the aforementioned exchange-ratio changing data is downloaded.

Further, according to the present invention, there is provided a configuration as follows.

(5) A gaming system according to the present invention includes a server, a plurality of gaming terminals and a network.

The aforementioned server includes a first network interface, a first memory, and a processor. The aforementioned first network interface is for communicating with the aforementioned plurality of gaming terminals. The aforementioned first memory stores denomination changing data for use in determining a denomination in the aforementioned gaming terminals. The aforementioned processor is designed or configured to download the aforementioned denomination changing data to the aforementioned gaming terminals.

The aforementioned gaming terminals include the second network interface, the controller and the second memory. The aforementioned second network interface is for communicating with the aforementioned server. The aforementioned controller determines the denomination using the aforementioned denomination changing data downloaded from the aforementioned server. Further, the aforementioned controller is designed or configured to execute games based on the determined denomination. The aforementioned second memory stores the aforementioned denomination changing data downloaded from the aforementioned server.

The aforementioned network enables communication between the aforementioned server and the aforementioned plurality of gaming terminals.

The aforementioned game software components are data, programs, modules and the like which are used in executing games in the gaming terminals. The aforementioned game software components may be, for example, game system components, payout tables, game bonusing programs, game progressive programs, graphic data, sound data, game jurisdiction information, game network components, and the like. The aforementioned controller can execute games using combinations of these game software components.

Further, there is no particular limitation on the triggers which cause the aforementioned processor to download the aforementioned game software components to the aforementioned gaming terminals. For example, such triggers may be a predetermined time, day and week of updating, predetermined updating events and the like. Also, such triggers may be inputs by the player, results of games, game histories and the like.

Further, the aforementioned controller can produce games using only game software components downloaded from the server. Also, the aforementioned controller can produce games using a combination of game software components downloaded from the server and game software components pre-stored in the second memory.

Further, the aforementioned controller can be designed or configured to execute applications for collecting information about each gaming terminal in the aforementioned server. The aforementioned applications may be, for example, a data analysis application, a configuration designing application, a scheduling designing application, a report creation application, a query configuration application, a game software version management application, and the like.

In the aforementioned gaming system, each gaming terminal can create game process data which will be described later and then can transmit it to the aforementioned server, and the server can store it in the aforementioned first memory. The game process data may be, for example, game version data, game data, gaming terminal data, player data, route data, venue data, and the like. The game process data can be stored in the aforementioned first memory as a database, in such a way that the game process data is separated from the aforementioned game software components.

In cases where the aforementioned gaming system includes gaming terminals provided by different entities, game software components and/or game process data can be stored in the aforementioned second memory, in such a way that they are divided for the respective entities. Also, it is possible to restrict the access to the game software components and/or the game process data relating to gaming terminals provided by different entities, in such a way that each entity can not access to the game software components and/or game process data relating to the other entities. Also, it is possible to define hierarchical access authorities of the respective devices which constitute the aforementioned gaming system for the aforementioned game software components and/or game process data, so that the access thereto can be restricted according to the hierarchical access authorities.

The aforementioned processor can be configured to conduct the following processes 1) to 4) for downloading the aforementioned game software components.

1) Processing for establishing communication with gaming terminals,
2) Processing for selecting game software components to be updated,
3) Processing for bundling the selected game software components, and
4) Processing for downloading the bundled game software components to the aforementioned gaming terminals.

Further, the aforementioned processor can conduct the following processes 1) to 11) for downloading the aforementioned game software components.

1) Processing for making contact with a local ISP (an internet service provider) prior to the start of transmission of the aforementioned game software components and transmitting the aforementioned game software components through the aforementioned local ISP,
2) Processing for checking the IP addresses of gaming terminals,
3) Processing for dividing the aforementioned game software components into a plurality of packets,
4) Processing for coding the aforementioned game software components,
5) Processing for creating instructions relating to the setting of the aforementioned game software components and transmitting the aforementioned instructions along with the aforementioned game software components,
6) Processing for making a request of the aforementioned gaming terminals for version information about the aforementioned game software components,
7) Processing for receiving the version information about the aforementioned game software components from the aforementioned gaming terminals,
8) Processing for receiving game process information from the aforementioned gaming terminals and storing the aforementioned game process information, according to game data categories (for example, game version data, game data, gaming terminal data, player data, route data, venue data and the like),
9) Processing for determining the access authority for the aforementioned game process information, prior to storing the game process information,
10) Processing for selecting data storage partitions from a plurality of data storage partitions corresponding to respective entities, and
11) Processing for checking updating triggers (for example, a time, day and week of updating, updating events, predetermined inputs by the player, results of games, game histories).

The aforementioned controller can conduct the following processes 1) to 5) for structuring game software.

1) Processing for establishing communication with the aforementioned server,
2) Processing for receiving game software components from the aforementioned server,
3) Processing for unbundling the aforementioned game software components,
4) Processing for creating a combination of game software components including the aforementioned game software components received from the aforementioned server, and
5) Processing for executing games using the aforementioned combination of game software components.

Further, the aforementioned gaming system can employ any of the following configurations a) to c).

a) The aforementioned server executes games, and the aforementioned gaming terminals display the results of the games,
b) The aforementioned gaming terminals execute games, the aforementioned server determines the result of games, and the aforementioned gaming terminals display the result of games, and
c) The aforementioned gaming terminals execute games and display the result of games, and the aforementioned server downloads the aforementioned game software components to the aforementioned gaming terminals.

In the present invention, with any of the aforementioned configurations (a) to (c), it is possible to download game software components to be used in the aforementioned gaming terminals from the aforementioned server to the aforementioned gaming terminals.

BRIEF DESCRIPTIONS OF THE DRAWINGS

DESCRIPTION OF THE EMBODIMENTS

Figure 1:
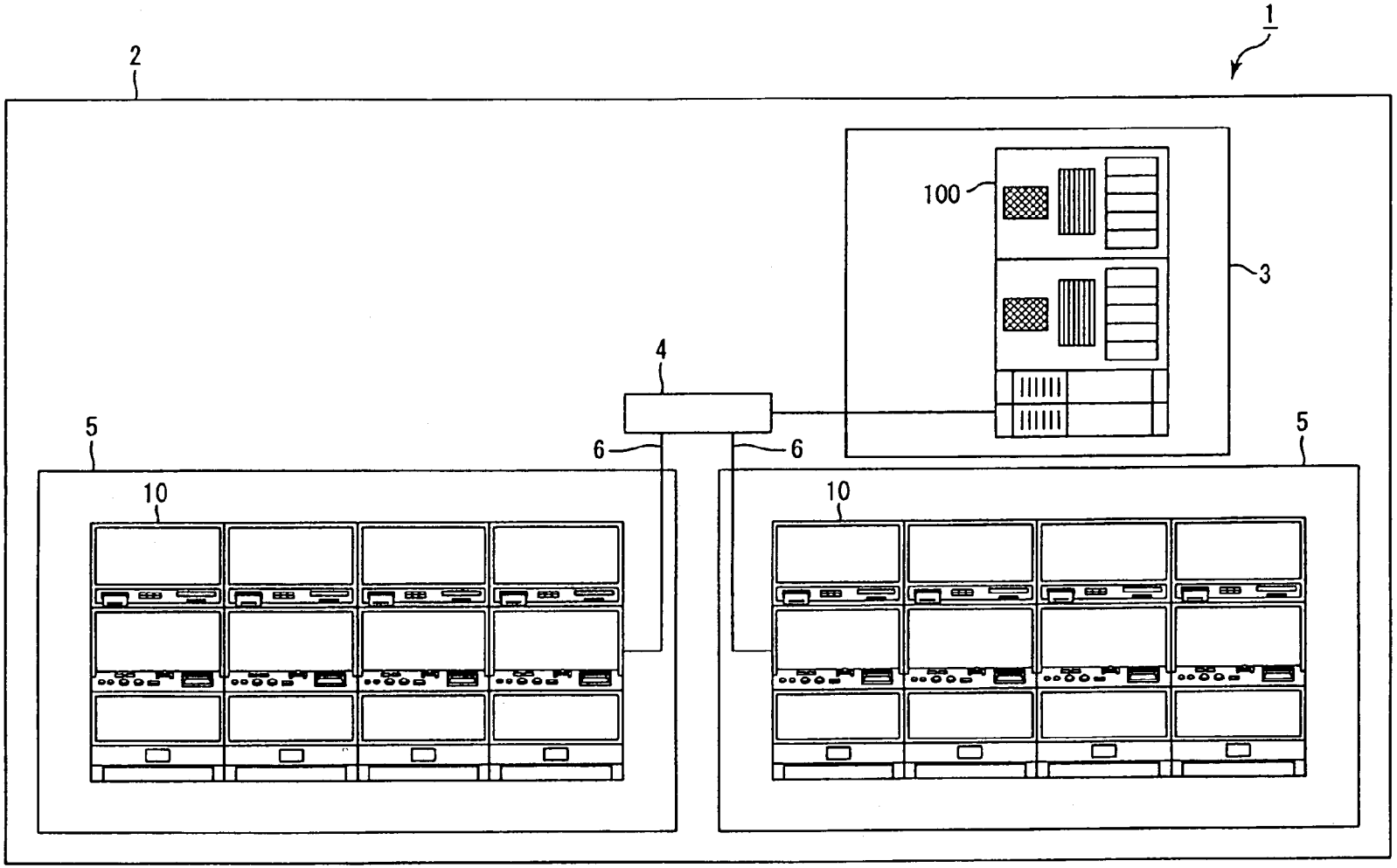
FIG. 1 is a network schematic diagram of a gaming system according to an embodiment of the present invention.

FIG. 1 is a network schematic diagram of a gaming system according to an embodiment of the present invention.

The gaming system 1 includes a server 100 and a plurality of slot machines (gaming terminals) 10 which are installed in a casino 2. The server 100 is installed in a computer room 3 in the casino 2. Further, the plurality of slot machines 10 are installed in a casino floor 5. The server 100 and the plurality of slot machines 10 are connected to each other through a router 4 and a LAN 6.

The server 100 includes management tools and downloading tools required for managing information about a certain slot machine 10 or a certain group of slot machines 10 and for managing data access of respective users. An operator of the server 100 who has valid access authority can set various types of parameters, as triggers for downloading programs and information such as game software components, exchange-ratio changing data, and denomination changing data, to the slot machines 10. Further, the server 100 can be either connected to a legacy system such as a cashless system and the like in the casino 2 or directly connected to the slot machines 10. Also, it is possible to utilize both of these structures to easily perform downloading of information and collection of data.

The slot machines 10 correspond to the gaming terminals according to the present invention. However, in the present invention, the gaming terminals are not limited to the case, but may be video slot machines, mechanical slot machines, gaming terminals capable of executing bingo games, Kino games, lottery games and the like.

The slot machines 10 are installed in the casino floor 5. However, in the present invention, there is no particular limitation on the venue in which the gaming terminals are installed, and the venue may be, for example, a casino, a store, a restaurant, a bar, a ship and the like. Also, the venue can be owned and/or managed by a plurality of entities. Also, the gaming system according to the present invention can be structured to include a plurality of different types of venues.

Each slot machine 10 transmits, to the server 100, game process information (for example, the number of inserted coins, the number of coins to be paid out), game-software-component information (for example, version information about software) and player tracking information (for example, the ID code of a player). Further, each slot machine 10 is capable of transmitting and receiving information to and from the server 100 and communicates with the server 100 through the router 4. The slot machines 10 can communicate with the server 100 through a legacy system.

Figure 2:
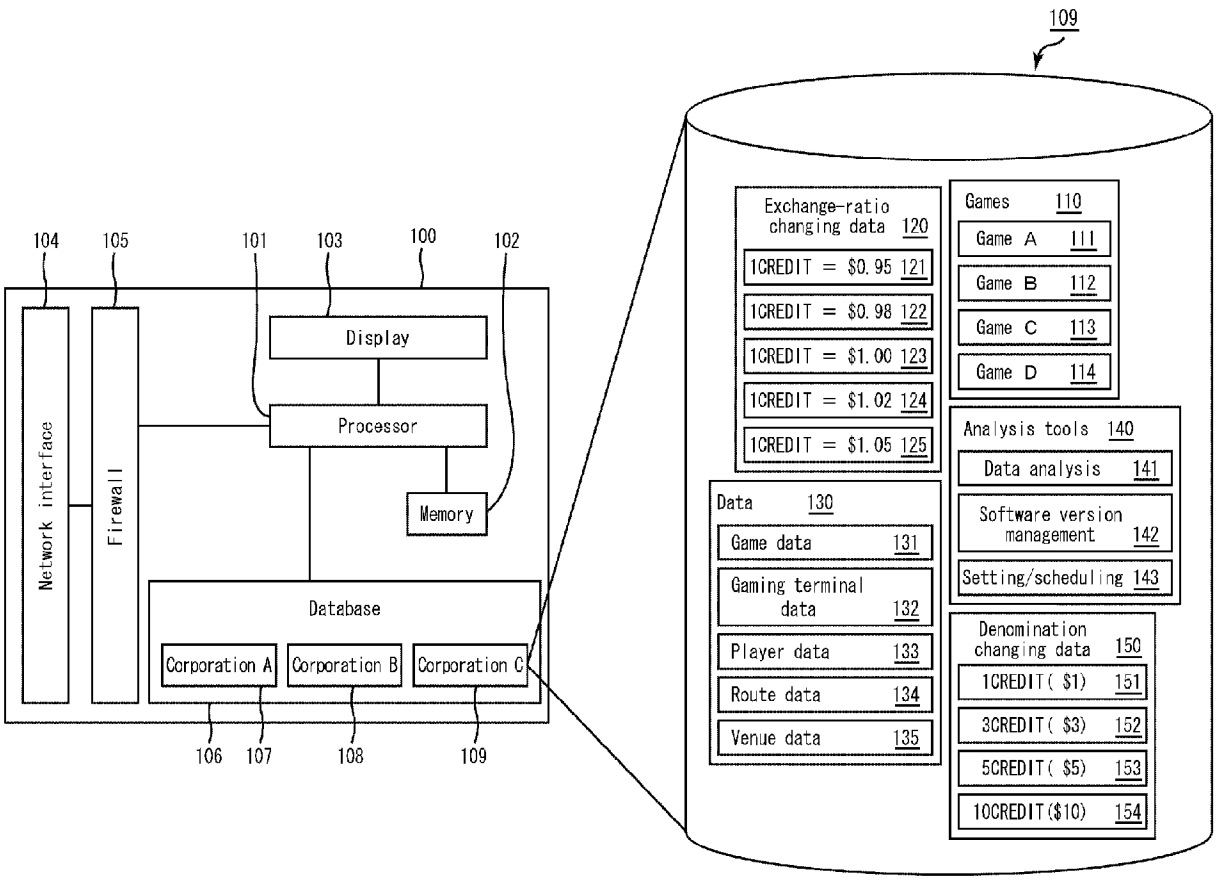
FIG. 2 is a block diagram illustrating the internal structure of the server according to an embodiment of the present invention.

FIG. 2 is a block diagram illustrating the internal structure of the server according to an embodiment of the present invention.

The server 100 includes a processor 101. A memory 102, a database 106 and a display 103 are connected to the processor 101. A network interface 104 is connected to the processor 101 through a firewall 105. The server 100 can communicate with the slot machines (gaming terminals) 10 and the remote terminal 200 through the network interface 104.

The processor 101 corresponds to the processor according to the present invention. The database 106 corresponds to the first memory according to the present invention. The network interface 104 corresponds to the first network interface according to the present invention.

The network interface 104 may be either a wired network interface or a wireless network interface or may include both of them. The server 100 includes a firewall 105 and intercepts, with the firewall 105, unauthorized accesses to the data within the server 100.

The database 106 is a hard disk drive. The database 106 stores, for example, game information such as game process information, game software components, game-software-component information and the like. In the present embodiment, the data in the database 106 is divided for respective entities, as exemplified as "Corporation A" 107, "Corporation B" 108 and "Corporation C" 109.

In the present invention, the number of divisions is not particularly limited, but may be changed as required. Further, the database 106 may be, for example, a well-known recording medium such as a hard disk drive, a CD-RW drive and the like or may be a combination of them.

The data for the respective entities in the database 106 will be described by exemplifying the data of "Corporation C" 109. As illustrated in FIG. 2, the data of "Corporation C" 109 includes games 110, exchange-ratio changing data 120, data 130, analysis tools 140, and denomination changing data 150.

The games 110 include game software of a game A 111, a game B 112, a game C 113 and a game D 114. Each of the game software is comprised of game system components, a payout table, a game bonusing program, a game progressive program, graphic data, sound data, game jurisdiction information, game network components and the like.

The game system components in the game software to be used in the slot machines 10 include, for example, a symbol selection program. The aforementioned symbol selection program is a program for determining symbols to be rearranged in a symbol matrix (see FIG. 3). The aforementioned symbol selection program includes symbol weighting data associated with respective plurality of types of payout ratios (for example, 80%, 84%, 88%). The symbol weighting data is data which designates the correspondence between respective symbols and one or more random numbers which fall within a predetermined numerical range (0 to 255). The payout ratios are defined on the basis of game jurisdiction information, and symbols to be rearranged in the symbol matrix are determined on the basis of the symbol weighting data associated with the payout ratios.

In the present invention, game software components refer to components which constitute game software. The game software can be structured such that its game software components can be replaced with components of other game software or may be structured such that its game software components can not be replaced.

Exchange-ratio changing data 120 is data for use in determining the currency values of credits and includes data indicating the exchange ratio between credits and currency values.

The exchange-ratio changing data 120 includes exchange-ratio changing data 121 of "1 credit=0.95 dollar", exchange-ratio changing data 122 of "1 credit=0.98 dollar", exchange-ratio changing data 123 of "1 credit=1.00 dollar", exchange-ratio changing data 124 of "1 credit=1.02 dollars", and exchange-ratio changing data 125 of "1 credit=1.05 dollars". These exchange-ratio changing data 121 to 125 constitute a group of exchange-ratio changing data "1 credit=1 dollar". While there is illustrated only the group "1 credit=1 dollar" in the figure, there may exist other groups (for example, a group "1 credit=0.01 dollar" and a group "1 credit=0.25 dollar"). Further, the group from which exchange-ratio changing data is to be selected can be determined according to the denomination specified by denomination changing data which will be described later. Further, as exchange-ratio changing data, there may be individually defined exchange-ratio changing data for use in exchanging a currency value for a credit and exchange-ratio changing data for use in exchanging a credit for a currency value.

The data 130 includes game data 131, gaming terminal data 132, player data 133, route data 134 and venue data 135.

The game data 131 includes, for example, the number of inserted coins, the number of coins to be paid out, the number of BETs per single game and the like. The gaming terminal data 132 includes, for example, data of game histories of the respective slot machines 10. This data is stored in association with the ID codes of the respective slot machines 10. The player data 133 includes, for example, data of game histories of respective players. This data is stored in association with the ID codes of the respective players. The route data 134 includes, for example, information about gaming terminals which belong to groups of gaming terminals existing in a route constituted by a plurality of venues. The venue data 135 includes, for example, information about gaming terminals which belong to the respective venues.

The analysis tools 140 include applications for data analysis 141 for defining categories in the data 130 and the relationship among the categories, software version management 142 for managing the versions of game software components in the respective gaming terminals and the versions of game software components to be downloaded thereto, and setting/scheduling 143 for setting the respective slot machines 10 in response to updating triggers. The processor 101 can execute these applications to conduct management and analysis of the data 109 of the entity "Corporation C".

Denomination changing data 150 includes denomination changing data 151 of "1 credit (1 dollar)", denomination changing data 152 of "3 credits (3 dollars)", denomination changing data 153 of "5 credits (5 dollars)", and denomination changing data 154 of "10 credits (10 dollars)". These denomination changing data 151 to 154 are associated with the group of exchange-ratio changing data "1 credit=1 dollar". Accordingly, in a case where any one of the exchange-ratio changing data 121 to 125 is employed, anyone of the denomination changing data 151 to 154 is employed.

While, in the figure, there are illustrated the denomination changing data 151 to 154, the denomination specified by denomination changing data is not limited to the case. Also, in the present invention, as previously described, along with or instead of such denomination changing data, it is possible to employ minimum-BET changing data.

Figure 3:
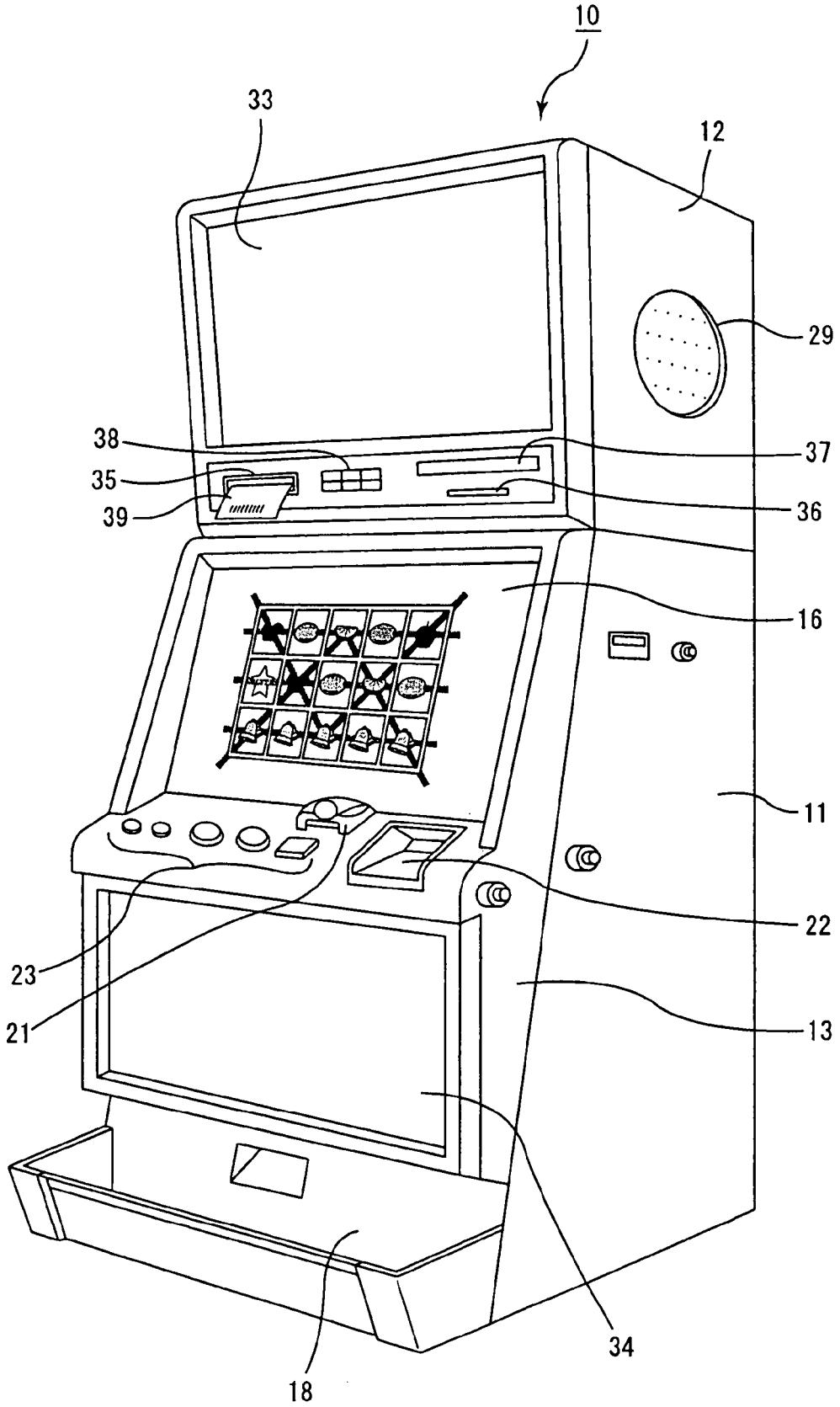
FIG. 3 is a perspective view schematically illustrating a slot machine (a gaming terminal) according to an embodiment of the present invention.

FIG. 3 is a perspective view schematically illustrating a slot machine according to an embodiment of the present invention.

The slot machine 10 includes a cabinet 11, a top box 12 installed at the upper portion of the cabinet 11 and a main door 13 provided in the front surface of the cabinet 11. A lower display 16 is provided in the front side of the main door 13. The lower display 16 includes a liquid crystal display panel which displays a symbol matrix constituted by a total of 15 symbols along 5 columns and 3 rows.

Although not illustrated, a touch panel 69 is provided in the front surface of the lower display 16, and the player can operate the touch panel 69 to input various types of commands. Further, under the lower display 16, there are provided various types of input buttons 23 which enables the player to input various types of commands relating to the game progress, a coin acceptor 21 which receives coins, and a bill validator 22 which determines whether or not bills are valid and receives valid bills. Also, the bill validator 22 can be configured to be capable of reading a ticket 39 with a bar code. In the lower front surface of the main door 13, a belly glass 34 on which characters and the like of the slot machine 10 are drawn is provided.

An upper display 33 is provided in the front surface of the top box 12. The upper display 33 includes a liquid crystal display panel which displays a payout table and the like.

Further, a speaker 29 is provided in the top box 12. Under the upper display 33, a ticket printer 35, a card reader 36, a data display 37 and a key pad 38 are provided. The ticket printer 35 prints, on a ticket, a bar code as coded data of the number of credits, the time and date, the identification number of the slot machine 10 and the like, and outputs the ticket as a ticket 39 with a bar code. It is possible for the player to make another slot machine to read the ticket 39 with a bar code and play a game on the slot machine, or exchange the ticket 39 with a bar code for bills and the like at a predetermined place in a game facility (e.g. a cashier in a casino).

The card reader 36 serves to read data from a smart card and write data into the smart card. The smart card is a card owned by the player and stores, for example, data for identifying the player, data of the history of games played by the player. The smart card can store data corresponding to coins, bills or a credit. Also, instead of such a smart card, it is possible to employ a magnetic stripe card. The data display 37 is comprised of a fluorescent display and the like, for example, data read by the card reader 36 and data inputted by the player through the key pad 38. The key pad 38 is for inputting commands and data relating to ticket issue and the like.

Figure 4:
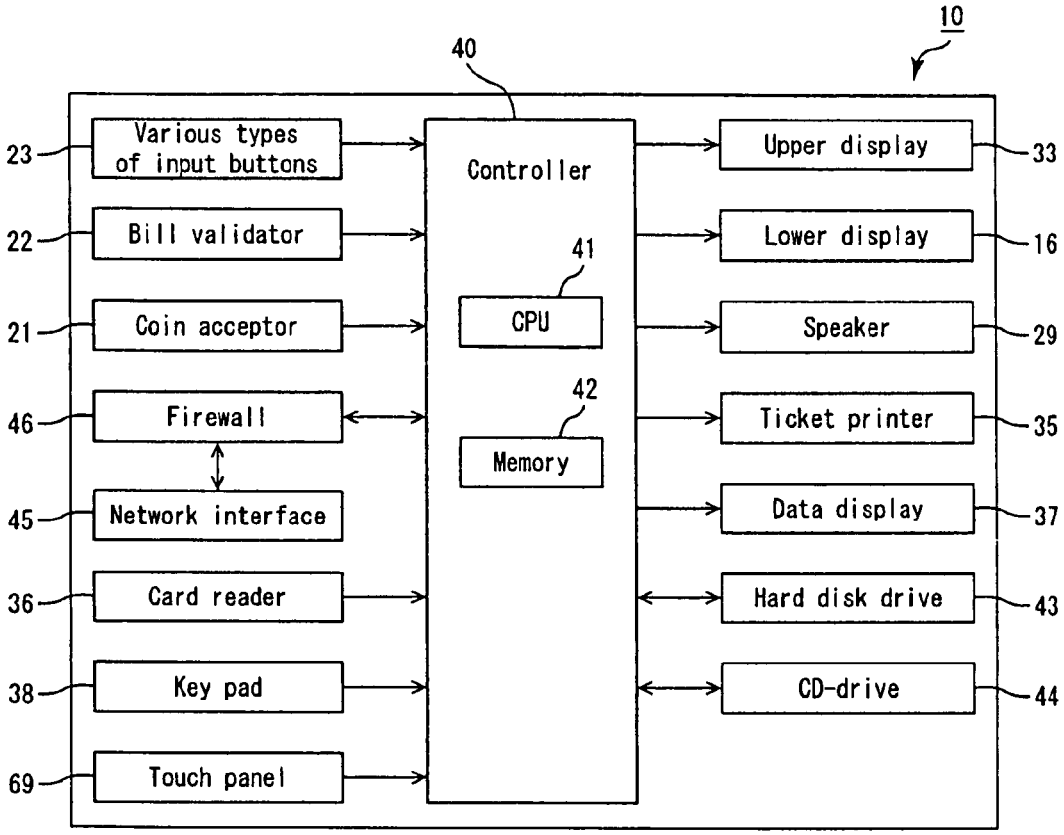
FIG. 4 is a block diagram illustrating the internal structure of the slot machine illustrated in FIG. 3.

FIG. 4 is a block diagram illustrating the internal structure of the slot machine illustrated in FIG. 3.

The slot machine 10 is provided with a controller 40 including a CPU 41 and a memory 42. The various types of input buttons 23, the bill validator 22 and the coin acceptor 21 are connected to the controller 40. Further, the network interface 45 is connected to the controller 40 through the firewall 46. Further, the card reader 36, the key pad 38 and the touch panel 69 are connected to the controller 40.

Further, the upper display 33, the lower display 16, the speaker 29, the ticket printer 35, the data display 37, the hard disk drive 43 and the CD-drive 44 are connected to the controller 40. Game software components downloaded from the server 100 are stored in the hard disk drive 43 and the like. The controller 40 executes, for example, various types of programs included in the game software components stored in the hard disk drive 43 and the like to conduct processing for displaying images to the upper display 33 and the lower display 16, processing for outputting sounds from the speaker 29, and the like. Further, the exchange-ratio changing data and the denomination changing data downloaded from the server 100 are stored in the hard disk drive 43. The controller 40 determines the exchange ratio between currency values and credits, based on the exchange-ratio changing data stored in the hard disk drive 43. Further, the controller 40 determines the denomination, based on the denomination changing data stored in the hard disk drive 43.

If there is an input of a currency value from the coin acceptor 21 or the bill validator 22, the controller 40 calculates the credit by multiplying the currency value by the exchange ratio and then stores the credit in the memory 42. The controller 40 determines the wager amount by multiplying the number of BETs by the denomination. In this case, the number of BETs refers to a unit of BETs input by the player. If a command for exchanging the credit for a currency value is generated, the controller 40 calculates the currency value by multiplying the credit by the exchange ratio and then pays out coins according to the currency value or issues a ticket 39 having the currency value recorded thereon.

The network interface 45 corresponds to the second network interface according to the present invention. The hard disk drive 43 corresponds to the second memory according to the present invention. The controller 40 corresponds to the controller according to the present invention.

Figure 5:
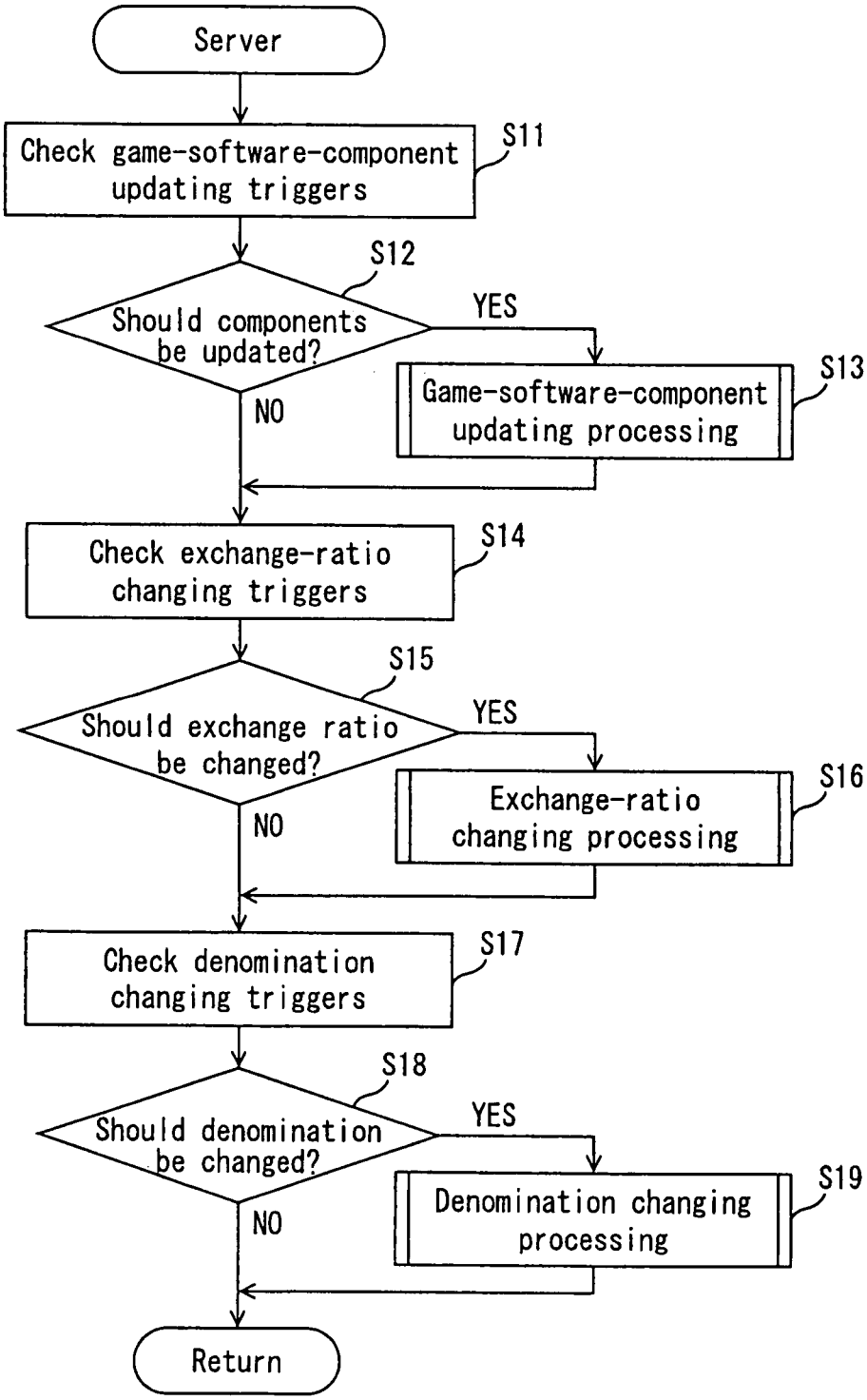
FIG. 5 is a flow chart illustrating processing which is conducted by a server according to an embodiment of the present invention.

FIG. 5 is a flow chart illustrating processing which is conducted by the server according to an embodiment of the present invention.

First, the processor 101 included in the server 100 checks updating triggers set in each slot machine 10 (gaming terminal) (step S11). A plurality of updating triggers can be set in each slot machine 10. For example, a time, day and week of updating, game events, results of games, game histories, inputs by the player and the like can be set as the aforementioned updating triggers. Also, a combination of a plurality of updating triggers can be employed, in such a way that the payout table is updated in the event of a game event during a certain time period in a certain day.

Next, the processor 101 determines whether or not the game software components should be updated, based on the result of the step S11 (step S12). If the processor 101 determines that the game software components should be updated, the processor 101 conducts game-component updating processing (step S13). The game-component updating processing will be described in detail later with reference to FIG. 6.

If the processor 101 determines, at the step S12, that the game software components should not be updated or if the processing at the step S13 has been conducted, then the processor 101 checks exchange-ratio changing triggers set in each slot machine 10 (step S14). A plurality of exchange-ratio changing triggers may be set in the slot machines 10. As the aforementioned exchange-ratio changing triggers, there may be set, for example, a predetermined time, day, week, game events, results of games, game histories, inputs by players and the like. Further, similarly to the aforementioned updating triggers, it is possible to employ a plurality of combinations of changing triggers.

Next, the processor 101 determines whether or not the exchange ratio should be changed, based on the result of the step S14 (step S15). If the processor 101 determines that the exchange ratio should be changed, then the processor 101 conducts exchange-ratio changing processing (step S16). The exchange-ratio changing processing will be described in detail later, with reference to FIG. 7.

If the processor 101 determines, at the step S15, that the exchange ratio should not be changed or if the exchange-ratio changing processing has been conducted, the processor 101 checks denomination changing triggers set in each slot machine 10 (step S17). A plurality of changing triggers may be set in the slot machines 10. As the aforementioned denomination changing triggers, there may be set, for example, a predetermined time, day, week, game events, results of games, game histories, inputs by players and the like. Further, similarly to the aforementioned updating triggers, it is possible to employ a plurality of combinations of changing triggers.

Next, the processor 101 determines whether or not the denomination should be changed, based on the result of the step S17 (step S18). If the processor 101 determines that the denomination should be changed, then the processor 101 conducts denomination changing processing (step S19). The denomination changing processing will be described in detail later, with reference to FIG. 8. If the processor 101 determines at the step S18 that the denomination should not be changed or if the processing at the step S19 has been conducted, the present processing is terminated.

Figure 6:
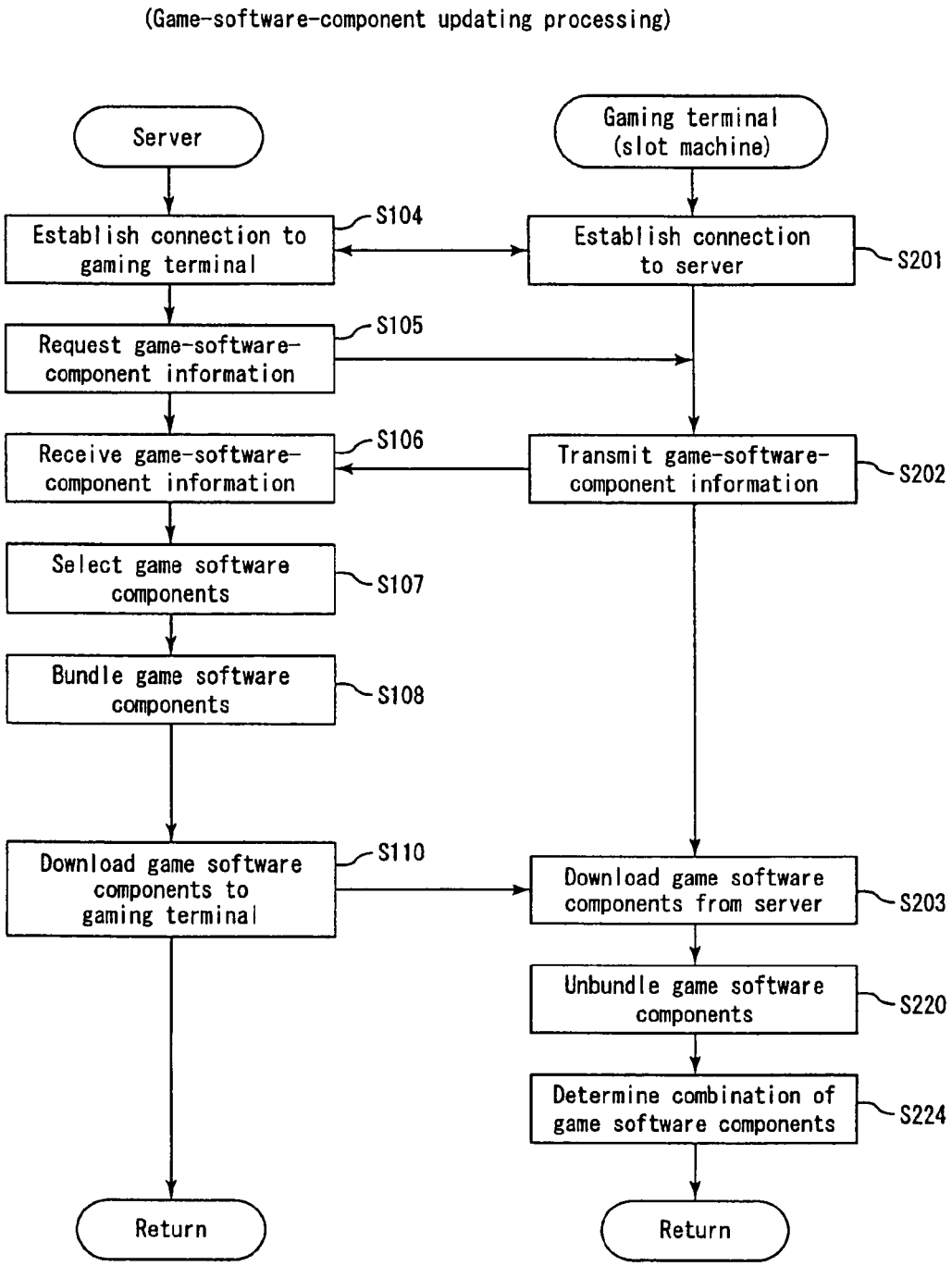
FIG. 6 is a flow chart of game-component updating processing conducted by a server and a slot machine according to an embodiment of the present invention.

FIG. 6 is a flow chart of the game-component updating processing conducted by the server and a slot machine according to an embodiment of the present invention.

First, the processor 101 conducts processing for establishing connection to the slot machines 10 for which software components should be updated (step S104). At this time, the controller 40 in each slot machine 10 (gaming terminal) conducts processing for establishing connection to the server 100 (step S201). When games are played in the slot machine 10, the processor 101 and the controller 40 conduct processing for establishing connection therebetween, after the games are ended. In this case, the term "when games are played in the slot machine 10" means, for example, when a credit is stored in the slot machine 10, the time interval from the determination of wager for games to the displaying of the results of games or to the payout according to the results of the aforementioned games, the time interval from the start of scrolling display of symbols to the rearrangement of symbols, and the like.

Next, the processor 101 makes a request of each slot machine 10 for game-software-component information (step S105).

On receiving the request for game-software-component information from the server 100, the controller 40 in each slot machine 10 transmits game-software-component information to the server 100 (step S202). The aforementioned game-software-component information includes, for example, the list of game software components stored in the hard disk drive 43 and the like, version information about game software components.

On receiving the game-software-component information from each slot machine 10, the processor 101 stores the information in the database 106 (step S106). Next, the processor 101 selects game software components to be downloaded (step S107).

Next, the processor 101 reads the selected game software components from the database 106 and bundles them in such a way that they can be downloaded to the slot machine 10 (step S108) The processing at the step S108 includes, for example, processing for coding the game software components, processing for compressing the game software components, processing for dividing the game software components into a plurality of packets, and the like.

Next, the processor 101 downloads the game software components to the slot machine 10 (step S110). At this time, each controller 40 downloads the game software components from the server 100 (step S203).

The controller 40 unbundles the downloaded game software components (step S220). The processing at the step 220 includes, for example, processing for decoding the game software components, processing for decompressing the game software components, combining packets, virus checks, and the like.

The controller 40 determines a new combination of game software components, using the downloaded game software components (step S224). In this case, the new combination of game software components can be determined, from only the downloaded game software components. Also, the new combination of game software components can be determined, from both the existing game software components and the downloaded game software components. After the determination of the combination of game software components, the present processing is terminated.

Figure 7:
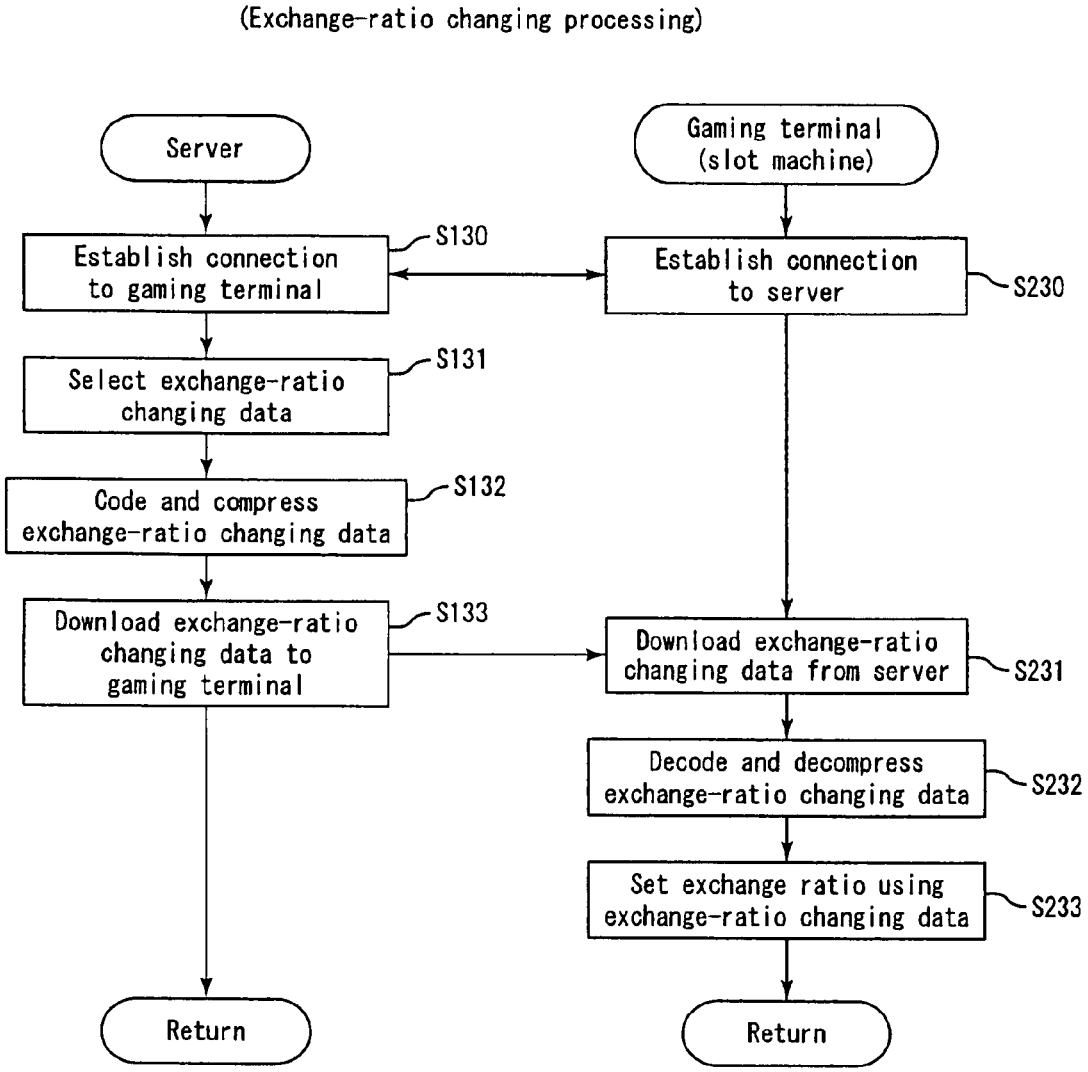
FIG. 7 is a flow chart of exchange-ratio changing processing which is conducted by a server and a slot machine according to an embodiment of the present invention.

FIG. 7 is a flow chart of the exchange-ratio changing processing conducted by the server and a slot machine according to an embodiment of the present invention.

First, the processor 101 conducts processing for establishing connection to the slot machine 10 which changes the exchange ratio (step S130). At this time, the controller 40 in each slot machine 10 (a gaming terminal) conducts processing for establishing connection to the server 100 (step S230). When games are executed in the slot machine 10, the processor 101 and the controller 40 conduct processing for establishing connection therebetween, after the games are ended.

Next, the processor 101 selects exchange-ratio changing data, out of a plurality of exchange-ratio changing data stored in the database 106 (step S131). The method for selecting single exchange-ratio changing data, out of the plurality of exchange-ratio changing data, may be, for example, a method selecting single exchange-ratio changing data at random using random numbers, a method selecting single exchange-ratio changing data according to a predetermined order, a method selecting single exchange-ratio changing data according to the payout ratio or the sales in the slot machine 10, a method selecting single exchange-ratio changing data according to the payout ratio or the sales in the entire gaming system 1.

Next, the processor 101 conducts processing for coding and compressing the selected exchange-ratio changing data (step S132). Then, the processor 101 conducts processing for downloading the exchange-ratio changing data to the slot machine (gaming terminal) 10 (step S133). At this time, each controller 40 downloads the exchange-ratio changing data from the server 100 (step S231).

Next, the controller 40 conducts processing for decoding and decompressing the exchange-ratio changing data (step S232). Then, the controller 40 stores the exchange-ratio changing data in the hard disk drive 43, defines an exchange ratio using the aforementioned exchange-ratio changing data and stores the content of setting in the memory 42 (step S233). Thereafter, the present processing is terminated.

Figure 8:
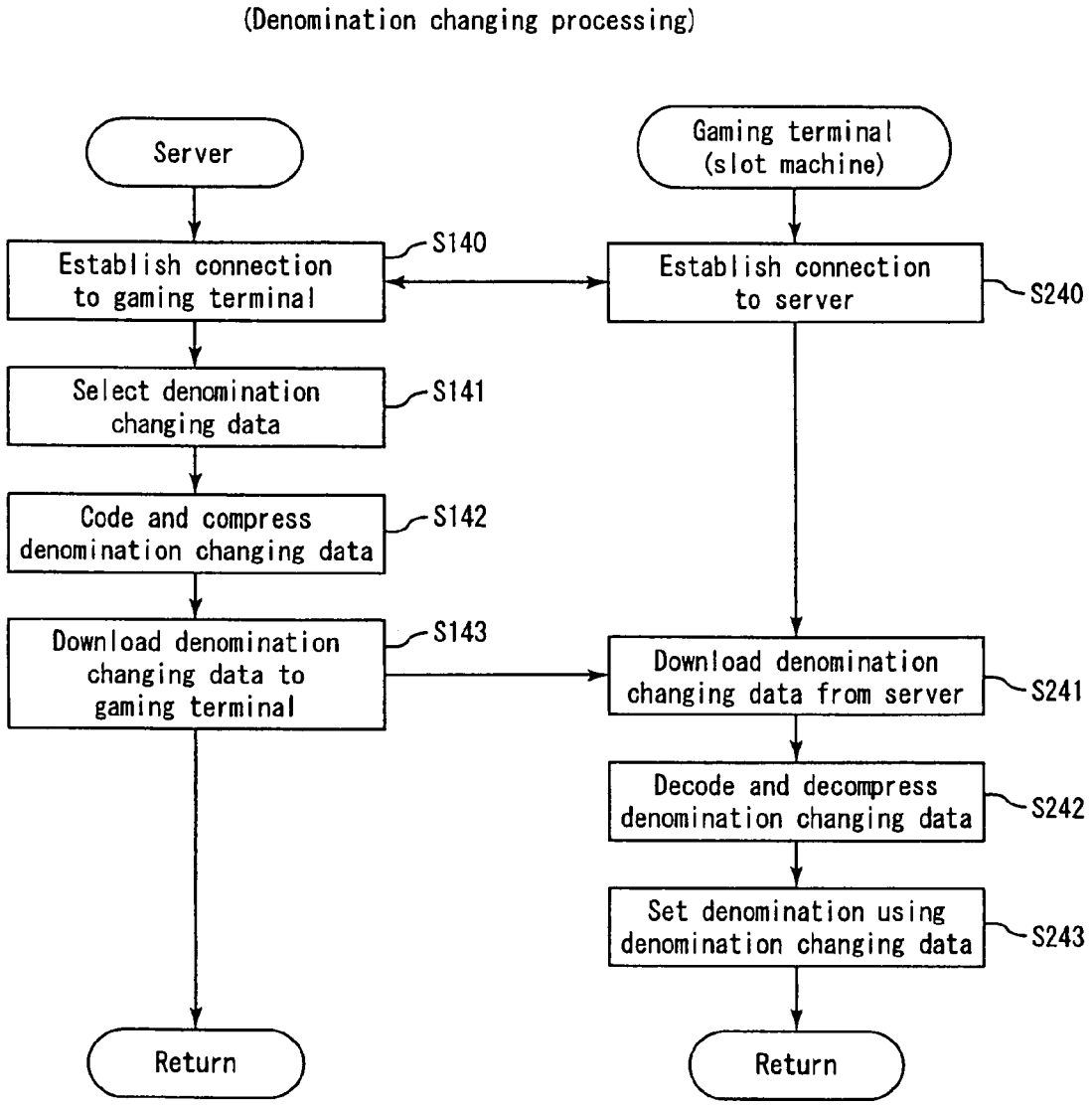
FIG. 8 is a flow chart of denomination changing processing which is conducted by a server and a slot machine according to an embodiment of the present invention.

FIG. 8 is a flow chart of the denomination changing processing conducted by the server and a slot machine according to an embodiment of the present invention.

First, the processor 101 conducts processing for establishing connection to the slot machine 10 which changes the denomination (step S140). At this time, the controller 40 in each slot machine 10 (a gaming terminal) conducts processing for establishing connection to the server 100 (step S240). When games are executed in the slot machine 10, the processor 101 and the controller 40 conduct processing for establishing connection therebetween, after the games are ended.

Next, the processor 101 selects denomination changing data from the database 106 (step S141). The method for selecting single denomination data out of a plurality of denomination changing data may be, for example, a method selecting single denomination data at random using random numbers, a method selecting single denomination data according to a predetermined order, a method selecting single denomination data according to the payout ratio and the sales of the slot machine 10, a method selecting single denomination data according to the payout ratio and the sales of the entire gaming terminal 1, and the like.

Next, the processor 101 conducts processing for coding and compressing the selected denomination changing data (step S142). Then, the processor 101 conducts processing for downloading the denomination changing data to the slot machine (a gaming terminal) 10 (step S143). At this time, each controller 40 downloads the denomination changing data from the server 100 (step S241).

Next, the controller 40 conducts processing for decoding and decompressing the denomination changing data (step S242) Then, the controller 40 stores the denomination changing data in the hard disk drive 43, defines a denomination using the aforementioned denomination changing data and stores the content of setting in the memory 42 (step S243). Thereafter, the present process is terminated.

Figure 9:
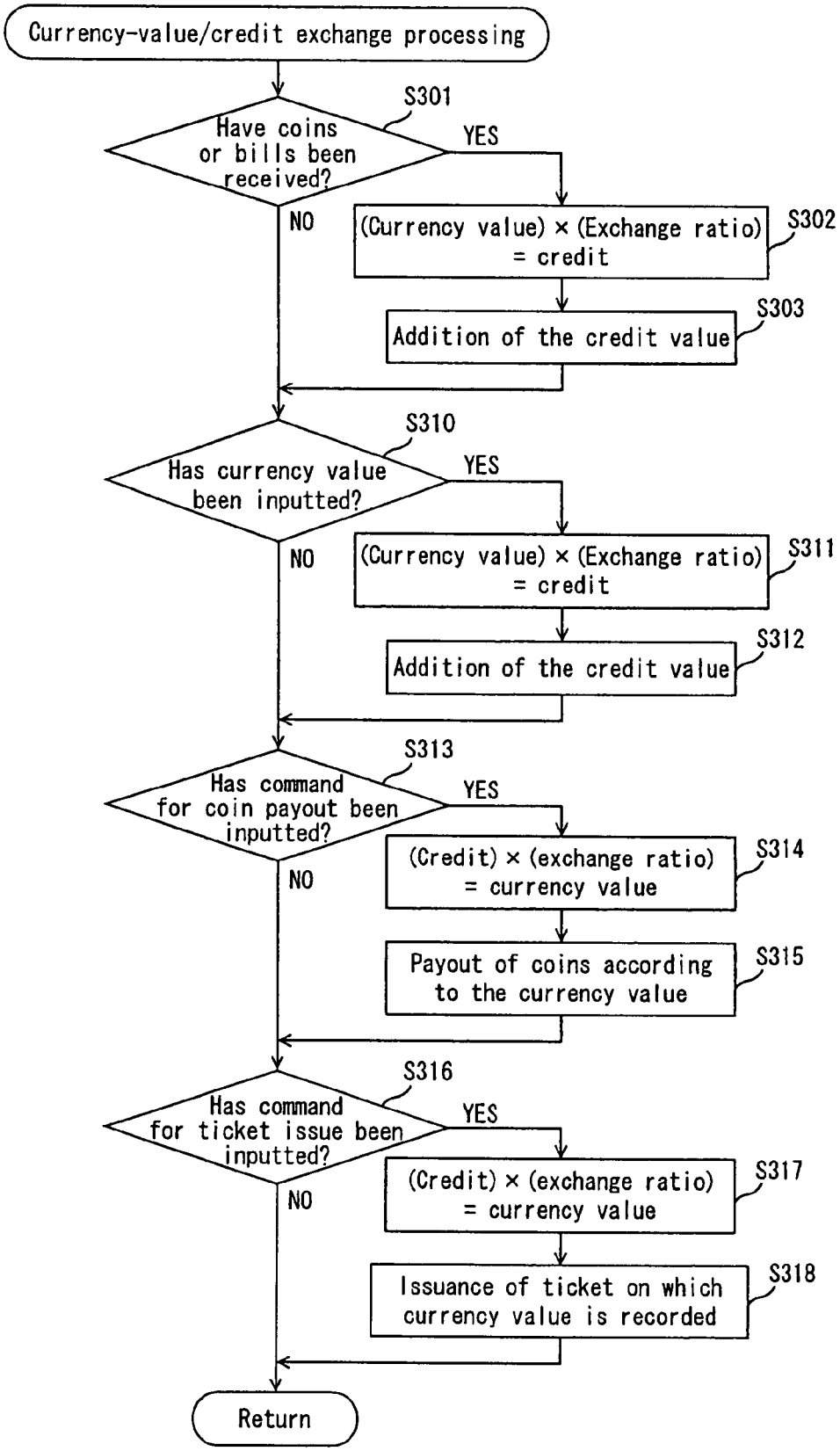
FIG. 9 is a flow chart illustrating currency-value/credit exchange processing which is conducted by a slot machine according to an embodiment of the present invention.

FIG. 9 is a flowchart illustrating currency-value/credit exchange processing which is conducted by a slot machine 10 according to an embodiment of the present invention.

The controller 40 determines whether or not coins or bills have been received (step S301). At the step S301, the controller 40 determines whether or not the coin acceptor 21 has detected coins or the bill validator 22 has detected bills. If the controller 40 determines that coins or bills have been received, the controller 40 multiplies the currency value of the coins or bills by the exchange ratio stored in the memory 42 to calculate the credit (step S302). Then, the controller 40 adds the calculated credit to the credit stored in the memory 42 and stores the resultant value in the memory 42 (step S303)

If the controller 40 determines, at the step S301, that no coins or bills have been received or if the processing at the step S303 has been conducted, then the controller 40 determines whether or not a currency value has been input (step S310). At the step S310, the controller 40 determines whether or not a currency value has been input through the card reader 36 or the key pad 38. If the controller 40 determines that a currency value has been input, the controller 40 multiplies the input currency value by the exchange ratio stored in the memory 42 to calculate the credit (step S311). Then, the controller 40 adds the calculated credit to the credit stored in the memory 42 and stores the resultant value in the memory 42 (step S312)

If the controller 40 determines that no currency value has been input or if the processing at the step S312 has been conducted, the controller 40 determines whether or not a command for coin payout has been input through the various types of input buttons 23 (step S313). If the controller 40 determines that a command for coin payout has been input, the controller 40 calculates the currency value by multiplying the credit stored in the memory 42 by the exchange ratio (step S314). At this time, the controller 40 also erases the credit stored in the memory 42. Then, the controller 40 pays out coins according to the currency value (step S315).

If the controller 40 determines that a command for coin payout has been input or if the processing at the step S315 has been conducted, the controller 40 determines whether or not a command for ticket issue has been input through the key pad 38 (step S316). If the controller 40 determines that a command for ticket issue has been input, the controller 40 calculates the currency value by multiplying the credit stored in the memory 42 by the exchange ratio (step S317). At this time, the controller 40 also erases the credit stored in the memory 42. Then, the controller 40 issues a ticket 39 including a bar code indicating the currency value printed thereon, through the ticket printer 35 (step S318). When the controller 40 determines that no command for ticket issue has been input or if the processing at the step S318 has been conducted, the present processing is terminated.

Figure 10:
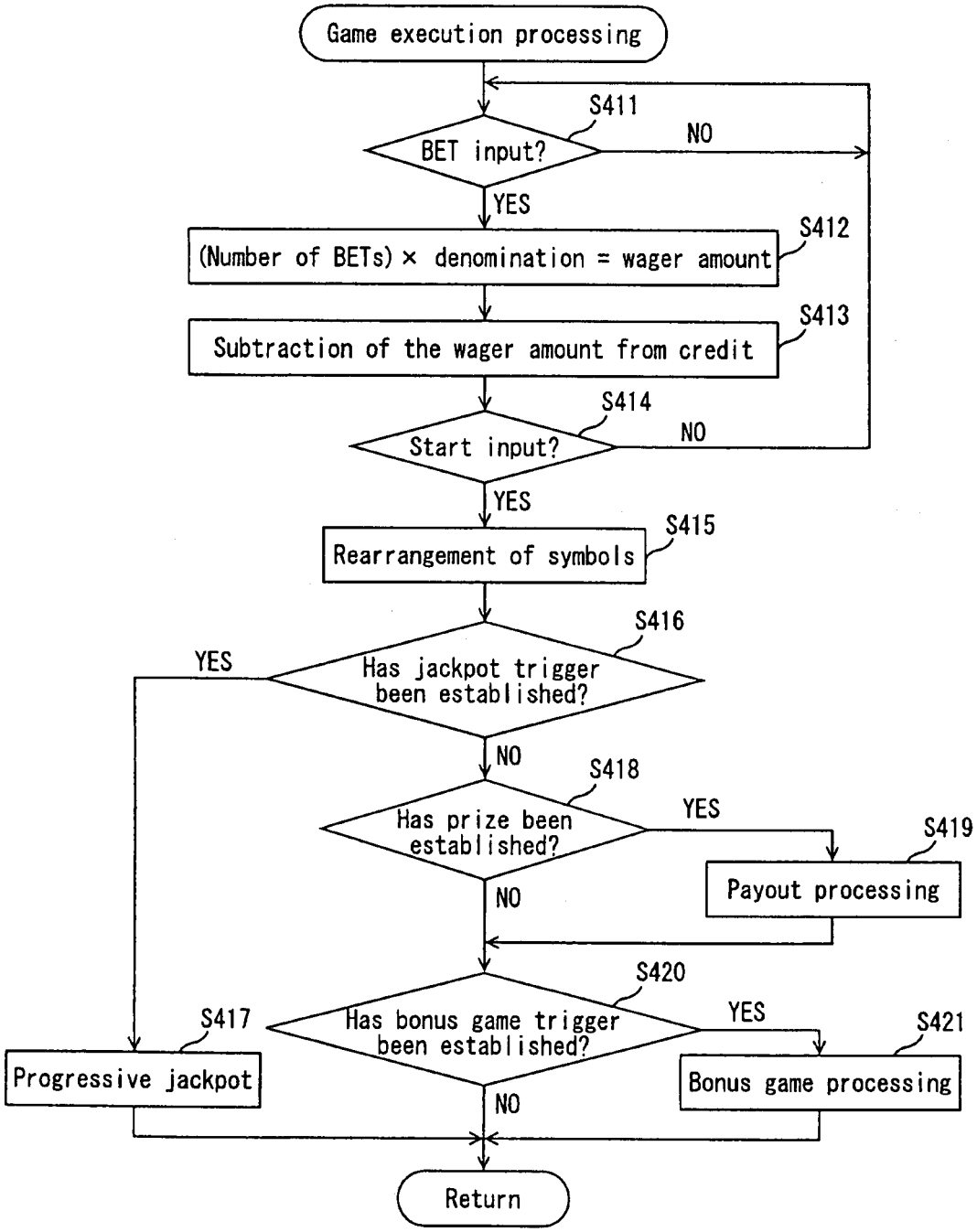
FIG. 10 is a flow chart illustrating game execution processing which is conducted by a slot machine according to an embodiment of the present invention.

FIG. 10 is a flow chart illustrating the game execution processing which is conducted by a slot machine 10 according to an embodiment of the present invention.

The controller 40 determines whether or not the player has input BETs by operating the various types of input buttons 23 (step S411). If the controller 40 determines that inputting of BETs has not been done, the processing at the step S411 is repeatedly conducted. On the other hand, if the controller 40 determines that inputting of BETs has been done, the controller 40 determines the wager amount by multiplying the number of bets by the denomination stored in the memory 42 (step S412). The wager amount is stored in the memory 42. Next, the controller 40 subtracts the wager amount from the credit stored in the memory 42 (step S413). Next, the controller 40 determines whether or not the player has input a command for start by operating the various types of input buttons 23 (step S414). If the controller 40 determines that a command for start has been input, the controller 40 rearranges symbols in a symbol matrix displayed to the lower display 16 (step S415). If this results in establishment of a jackpot trigger (a combination of symbols corresponding to a jackpot) in the symbol matrix, the controller 40 conducts a progressive jackpot (step S417). On the other hand, if no jackpot trigger is established, the controller 40 determines whether or not a prize has been established (step S418). If the controller 40 determines that a prize has been established, the controller 40 conducts coin payout processing (step S419). If the controller 40 determines at the step S418 that no prize has been established or if the processing at the step S419 has been conducted, the controller 40 determines whether or not a bonus game trigger (a combination of symbols corresponding to a bonus game) has been established (step S420). If the controller 40 determines that a bonus game trigger has been established, the controller 40 conducts processing for executing a bonus game (step S421). In this case, such a bonus game refers to, for example, a predetermined number of free games, a mystery bonus, a second game and the like.

FIG. 8 is a network schematic diagram of a gaming system according to another embodiment of the present invention.

The gaming system 500 includes a server 100. Further, the gaming system 500 includes, as gaming terminals, slot machines 10, a lottery game terminal 512, a Kino game terminal 513, a bingo game system 521, gaming systems 522 and 523, video poker game machines 531 and 532, personal computers 540 and 541 and a portable phone 550.

The server 100 is installed in a casino 501. The plurality of slot machines 10, cashiers 502 and 503, an account 504 and an audit 505 are connected to the server 100 through a LAN 562.

Further, the server 100 is connected to a cashier 511 installed in a restaurant 510, through a secure private intranet 565. Further, the cashier 511 is connected to the lottery game terminal 512 and the Kino game terminal 513, through the LAN 563.

As described above, in the present invention, the server and the gaming terminals can be connected to each other through an intranet. Further, another device (a cashier 511) may be interposed between the server and the gaming terminals.

Further, the server 100 is connected to the bingo game system 521 installed in another casino 520, through the internet 560. The bingo game system 521 is connected to gaming terminals 522 and 523 for executing bingo games, through a LAN 564. Further, the server 100 is connected to the plurality of video poker game machines 531 and 532 installed in a commercial facility 530, through the internet 560. Further, the server 100 is connected to the personal computers 540 and 541 and the portable phone 550, through the internet 560. As described above, in the present invention, the server and the gaming terminals can be connected to each other through the internet. Also, the gaming terminals may be personally-owned devices, such as the personal computers 540, 541 and the portable phone 550.

Although the present invention has been described with reference to embodiments thereof, these embodiments merely illustrate concrete examples, not restrict the present invention. The concrete structures of respective means and the like can be designed and changed as required. Furthermore, there have been merely described most preferable effects of the present invention, as the effects of the present invention, in the embodiments of the present invention. The effects of the present invention are not limited to those described in the embodiments of the present invention.

Further, in the aforementioned detailed description, characteristic portions have been mainly described, for ease of understanding the present invention. The present invention is not limited to the embodiments described in the aforementioned detailed description, but can be also applied to other embodiments over a wider range of applications. Further, the terms and phrases used in the present specification have been used for clearly describing the present invention, not for limiting the interpretation of the present invention. Further, those skilled in the art will easily conceive other structures, systems, methods and the like which are included in the concept of the present invention, from the concept of the present invention described in the present specification. Accordingly, the description of the claims is intended to include equivalent structures that fall within the technical scope of the invention. Further, the abstract aims at enabling engineers and the like who belong to the present technical field but are not familiar with the patent office and public institutions, the patent, law terms and technical terms to immediately understand the technical content and the essence of the present application through brief studies. Accordingly, the abstract is not intended to restrict the scope of the invention which should be evaluated from the description of the claims. It is desirable that literatures and the like which have been already disclosed are sufficiently studied and understood, in order to sufficiently understand the objects of the present invention and the specific effects of the present invention.

In the aforementioned detailed description, there have been described processes to be executed by computers. The aforementioned description and expressions have been described for the sake of enabling those skilled in the art to understand the present invention most effectively. In the present specification, each step for deriving a single result should be understood to be self-consistent processing. Further, each step includes transmission, reception, recording and the like of electric or magnetic signals. Although, in the processing at each step, such signals have been expressed as bits, values, symbols, characters, terms, numerical characters and the like, it should be noticed that they have been merely used for convenience of description. Further, although the processing at each step was described using expressions common to human behaviors in some cases, the processes described in the present specification are to be executed by various types of devices, in principle. Further, other structures required for conducting each step will be apparent from the aforementioned description.

What is claimed as new and desired to be secured by Letters Patent of the United States is:

1. A gaming system comprising:

a server;

a plurality of gaming terminals; and a network which enables communication between said server and said plurality of gaming terminals, said server comprising (A) a first network interface for communicating with said plurality of gaming terminals, (B) a first memory which stores exchange ratio changing data for use in determining an exchange ratio for exchanging currency values, which are inserted in gaming terminals, with credits necessary for executing a game in the gaming terminals, and (C) a processor designed or configured to download said exchange ratio changing data to said gaming terminals, and said gaming terminals each comprising (I) a second network interface for communicating with said server, (II) a controller designed or configured to (i) determine the exchange ratio between credits and currency values using said exchange ratio changing data downloaded from said server, (ii) exchange the currency values inserted into the gaming terminals with the credits calculated by multiplying the currency values by the determined exchange ratio and (iii) add the exchanged credits to a stored credit of a player, and (III) a second memory which stores said exchange ratio changing data downloaded from said server;

wherein when a predetermined condition is satisfied, new exchange ratio changing data is downloaded from the server to change the exchange ratio for exchanging the currency values with the credits and wherein at a time that the new exchange ratio changing data is downloaded from the server, the new exchange ratio changing data is selected by a random number from a plurality of sets of exchange ratio changing data.

2. The gaming system according to claim 1, wherein said first memory stores denomination changing data for use in determining a denomination in said gaming terminals, said processor is designed or configured to download said denomination changing data to said gaming terminals, said controller is designed or configured to determine the denomination using said denomination changing data downloaded from said server and execute a game based on the determined denomination, and said second memory stores said denomination changing data downloaded from said server.

3. The gaming system according to claim 1, wherein said first memory stores game software components to be used in said gaming terminals, said processor is designed or configured to download said game software components, said controller is designed or configured to produce games to be executed in said gaming terminals, using said game software components downloaded from said server, and said second memory stores said game software components downloaded from said server.

4. The gaming system according to claim 1, wherein said processor is designed or configured to download said exchange ratio changing data to said plurality of gaming terminals at the same time, and said controller determines the exchange ratio between credits and currency values using said exchange ratio changing data, when said exchange ratio changing data is downloaded from said server or after the end of games if games are executed at the time when said exchange ratio changing data is downloaded.

5. The gaming system of claim 1, wherein the predetermined condition is at least one of time, day, week, event, player input, game result and game history.

6. A gaming system comprising:

a server;

a plurality of gaming terminals; and a network which enables communication between said server and said plurality of gaming terminals, said server comprising a first network interface for communicating with said plurality of gaming terminals, a first memory which stores denomination changing data for use in determining a denomination in said gaming terminals and exchange ratio changing data for use in determining an exchange ratio for exchanging currency values, which are inserted in gaming terminals, with credits necessary for executing a game in the gaming terminals, and a processor designed or configured to download said denomination changing data to said gaming terminals, and said gaming terminals each comprising a second network interface for communicating with said server, a controller designed or configured to determine the denomination using said denomination changing data downloaded from said server and execute a game based on the determined denomination, and a second memory which stores said denomination changing data downloaded from said server and said exchange ratio changing data for use in determining an exchange ratio for exchanging currency values, which are inserted in gaming terminals, with credits necessary for executing a game in the gaming terminals;

wherein when a predetermined condition is satisfied, new denomination changing data is downloaded from the server to change the denomination and wherein at a time that the new denomination changing data is downloaded from the server, the new denomination changing data is selected sequentially according to a predetermined order from a plurality of sets of denomination changing data.

7. The gaming system of claim 6, wherein the predetermined condition is at least one of time, day, week, event, player input, game result and game history.

8. A server comprising:

(A) a first network interface for communicating with a plurality of gaming terminals;

(B) a first memory which stores exchange ratio changing data for use in determining an exchange ratio for exchanging currency values, which are inserted in gaming terminals, with credits necessary for executing a game in the gaming terminals, and (C) a processor designed or configured to download said exchange ratio changing data to said gaming terminals, determine the exchange ratio between credits and currency values using said exchange ratio changing data downloaded, exchange the currency values inserted into the gaming terminals with the credits calculated by multiplying the currency values by the determined exchange ratio, and add the exchanged credits to a stored credit of a player, wherein when a predetermined condition is satisfied, new exchange ratio changing data is downloaded from the server to change the exchange ratio for exchanging the currency values with credits and wherein at a time that the new exchange ratio changing data is downloaded from the server, the new exchange ratio changing data is selected according to a payout ratio or a sale in the gaming terminal from a plurality of sets of exchange ratio changing data.

9. The server according to claim 8, wherein said first memory stores denomination changing data for use in determining a denomination in said gaming terminals, and said processor is designed or configured to download said denomination changing data to said gaming terminals.

10. The server according to claim 8, wherein said first memory stores game software components to be used in said gaming terminals, and said processor is designed or configured to download said game software components.

11. The server according to claim 8, wherein said processor is designed or configured to download said data to said plurality of gaming terminals at the same time.

12. A server comprising:

a first network interface for communicating with a plurality of gaming terminals;

a first memory which stores denomination changing data for use in determining a denomination in said gaming terminals and exchange ratio changing data for use in determining an exchange ratio for exchanging currency values, which are inserted in gaming terminals, with credits necessary for executing a game in the gaming terminals; and a processor designed or configured to download to said gaming terminals said denomination changing data and said exchange ratio changing data, determine the exchange ratio between credits and currency values using said exchange ratio changing data downloaded, exchange the currency values inserted into the gaming terminals with the credits calculated by multiplying the currency values by the determined exchange ratio, and add the exchanged credits to a stored credit of a player;

wherein when a predetermined condition is satisfied, new denomination changing data and exchange ratio changing data is downloaded from the server to change the denomination and wherein at a time that the new denomination changing data and exchange ratio changing data is downloaded from the server, the new denomination changing data and exchange ratio changing data is selected according to a payout ratio or an entire sale in the gaming system from a plurality of sets of denomination changing data and exchange ratio changing data.

13. A gaming terminal comprising:

(I) a second network interface for communicating with a server;

(II) a controller designed or configured to (i) determine an exchange ratio between credits necessary for executing a game at the gaming terminal and monetary values inserted in the gaming terminal, (ii) exchange a monetary value for a credit calculated by multiplying the monetary value by the determined exchange ratio, and (iii) add the exchanged credits to a stored credit of a player; and (Ill) a second memory which stores said exchange ratio changing data downloaded from said server;

wherein when a predetermined condition is satisfied, new exchange ratio changing data is downloaded from the server to change the exchange ratio for exchanging the currency values with credits and wherein at a time that the new exchange ratio changing data is downloaded from the server, the new exchange ratio changing data is selected by a random number from a plurality of sets of exchange ratio changing data.

14. The gaming terminal according to claim 13, wherein said controller is designed or configured to determine a denomination using denomination changing data downloaded from said server and execute a game based on the determined denomination, and said second memory stores said denomination changing data downloaded from said server.

15. The gaming terminal according to claim 13, wherein said controller is designed or configured to produce games to be executed in said gaming terminals, using game software components downloaded from said server, and said second memory stores said game software components downloaded from said server.

16. The gaming terminal according to claim 13, wherein said controller determines the exchange ratio between credits and currency values using said exchange ratio changing data, when said exchange ratio changing data is downloaded from said server or after the end of games if games are executed at the time when said exchange ratio changing data is downloaded.

17. A gaming terminal comprising:

a second network interface for communicating with a server;

a controller designed or configured to determine a denomination using denomination changing data downloaded from said server and execute a game based on the determined denomination; and a second memory which stores said denomination changing data downloaded from said server and exchange ratio changing data for use in determining an exchange ratio for exchanging currency values, which are inserted in gaming terminals, with credits necessary for executing a game in the gaming terminals;

wherein when a predetermined condition is satisfied, new denomination changing data is downloaded from the server to change the denomination and wherein at a time that the new denomination changing data is downloaded from the server, the new denomination changing data is selected sequentially according to a predetermined order from a plurality of sets of denomination changing data.

18. A game control method comprising:

a downloading step conducted by a server of downloading to a gaming terminal exchange ratio changing data for use in determining an exchange ratio for exchanging monetary values, which are inserted into said gaming terminal, and credits necessary for executing a game at the gaming terminal;

an exchange ratio determining step conducted by said gaming terminal of determining the exchange ratio between credits and currency values using said exchange ratio changing data downloaded from said server, and an exchanging step conducted by said gaming terminal of exchanging a monetary value for a credit calculated by multiplying the monetary value by the determined exchange ratio, and an adding step conducted by said gaming terminal of adding the exchanged credits to a stored credit of a player, wherein when a predetermined condition is satisfied, new exchange ratio changing data is downloaded from the server to change the exchange ratio for exchanging the currency values with credits and wherein at a time that the new exchange ratio changing data is downloaded from the server, the new exchange ratio changing data is selected according to a payout ratio or a sale in the gaming terminal from a plurality of sets of exchange ratio changing data.

19. The game control method according to claim 18, further comprising a downloading step conducted by said server of downloading denomination changing data for use in determining a denomination in said gaming terminal, to said gaming terminals;

a denomination determining step conducted by said gaming terminal of determining the denomination using said denomination changing data downloaded from said server; and a game executing step conducted by said gaming terminal of executing a game based on the determined denomination.

20. The game control method according to claim 18, further comprising a downloading step conducted by said server of downloading game software components to be used in said gaming terminal, to said gaming terminal; and a game producing step conducted by said gaming terminal of producing a game to be executed in said gaming terminal, using said game software components downloaded from said server.

21. The game control method according to claim 18, wherein said server downloads said exchange ratio changing data to a plurality of said gaming terminals at the same time, and said gaming terminal determines the exchange ratio between credits and currency values using said exchange ratio changing data, when said exchange ratio changing data is downloaded from said server or after the end of a game if a game is executed at the time when said exchange ratio changing data is downloaded.

22. A game control method comprising:

a downloading step conducted by a server of downloading to a gaming terminal denomination changing data for use in determining a denomination in said gaming terminal and exchange ratio changing data for use in determining an exchange ratio for exchanging currency values, which are inserted into said gaming terminal, and credits necessary for executing a game at the gaming terminal;

a denomination determining step conducted by said gaming terminal of determining the denomination using said denomination changing data downloaded from said server; and a game executing step conducted by said gaming terminal of executing a game based on the determined denomination;

wherein when a predetermined condition is satisfied, new denomination changing data is downloaded from the server to change the denomination and wherein at a time that the new denomination changing data is downloaded from the server, the new denomination changing data is selected according to a payout ratio or an entire sale in the gaming system from a plurality of sets of denomination changing data.

23. A gaming system comprising:

a server;

a plurality of gaming terminals; and a network which enables communication between said server and said plurality of gaming terminals, said server comprising (A) a first network interface for communicating with said plurality of gaming terminals, (B) a first memory which stores a plurality of sets of exchange ratio changing data, each set of exchange ratio changing data being for use in determining an exchange ratio between a monetary value input to a gaming terminal and a credit necessary for playing a game on the gaming terminal and a monetary value, and (C) a processor designed or configured to download one of the plurality of sets of exchange ratio changing data to said gaming terminals, and said gaming terminals each comprising (I) a second network interface for communicating with said server, (II) a controller designed and configured to (i) determine the exchange ratio between credits and currency values using the one of the plurality of sets of exchange ratio changing data downloaded from said server and (ii) exchange a monetary value input to the gaming terminal for a credit calculated by multiplying the currency values by the determined exchange ratio and (iii) add the exchanged credits to a stored credit of a player, and (III) a second memory which stores the one of the plurality of sets of exchange ratio changing data downloaded from said server, wherein the first memory stores therein the plurality of sets of the exchange ratio changing data to cover from a first exchange ratio to a second exchange ratio lower than the first exchange ratio, each set of exchange ratio changing data containing an exchange ratio between a monetary value to be input to the gaming terminal and a credit necessary for playing a game on the gaming terminal;

when a predetermined condition is met, the one of the plurality of sets of exchange ratio changing data is selected and downloaded and wherein at a time that the one of the plurality of sets of exchange ratio changing data is selected and downloaded, the one of the plurality of sets of exchange ratio changing data is selected by a random number.

* * * * *